US009085179B2

(12) United States Patent
Noguchi

(10) Patent No.: US 9,085,179 B2
(45) Date of Patent: Jul. 21, 2015

(54) PRINTER AND PRINTING METHOD

(75) Inventor: Akihiko Noguchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 536 days.

(21) Appl. No.: 13/249,083

(22) Filed: Sep. 29, 2011

(65) Prior Publication Data

US 2012/0082500 A1 Apr. 5, 2012

(30) Foreign Application Priority Data

Oct. 1, 2010 (JP) ..... 2010-224107

(51) Int. Cl.
*B41J 11/00* (2006.01)
*B41J 15/04* (2006.01)
*B41J 11/42* (2006.01)

(52) U.S. Cl.
CPC . *B41J 15/04* (2013.01); *B41J 11/42* (2013.01)

(58) Field of Classification Search
USPC ..... 400/582
See application file for complete search history.

(56) References Cited

U.S. PATENT DOCUMENTS

| | | | | |
|---|---|---|---|---|
| 4,732,501 | A * | 3/1988 | Angst et al. | 400/616.3 |
| 5,296,906 | A * | 3/1994 | Hano et al. | 399/385 |
| 5,423,620 | A * | 6/1995 | Tokairin | 400/582 |
| 5,676,479 | A * | 10/1997 | Yamaguchi et al. | 400/709 |
| 5,711,846 | A * | 1/1998 | Alicea | 156/556 |
| 5,984,469 | A * | 11/1999 | Koike et al. | 347/104 |
| 6,106,176 | A | 8/2000 | Yanagisawa et al. | |
| 6,259,868 | B1 * | 7/2001 | Fujii et al. | 399/45 |
| 6,450,384 | B1 * | 9/2002 | Chinzei et al. | 226/59 |
| 7,039,334 | B2 | 5/2006 | Deguchi | |
| 2003/0185581 | A1 * | 10/2003 | Hisada | 399/45 |
| 2005/0035988 | A1 | 2/2005 | Liao et al. | |
| 2006/0249895 | A1 * | 11/2006 | Kern | 271/182 |
| 2008/0230975 | A1 * | 9/2008 | Matsuzuki et al. | 270/52.08 |
| 2011/0228289 | A1 | 9/2011 | Yamamoto et al. | |

FOREIGN PATENT DOCUMENTS

| | | | |
|---|---|---|---|
| CN | 1232753 | A | 10/1999 |
| JP | 02-115880 | A | 4/1990 |
| JP | 03-155395 | A | 7/1991 |
| JP | 06-009111 | A | 1/1994 |
| JP | 06-305128 | A | 11/1994 |
| JP | 2004-357449 | A | 12/2004 |
| JP | 2005-153258 | A | 6/2005 |
| JP | 3791423 | B2 | 6/2006 |
| JP | 2009-242047 | A | 10/2009 |
| TW | 580450 | B | 3/2004 |
| TW | 200924983 | A | 6/2009 |

* cited by examiner

*Primary Examiner* — Anthony Nguyen
(74) *Attorney, Agent, or Firm* — Kilpatrick Townsend & Stockton LLP

(57) ABSTRACT

A printer with a tractor unit driven by a DC motor and a printing control method that acquires accurate load information when continuous paper is loaded. The printer has a printhead 2 that can move in a primary scanning direction and has discharge nozzles that discharge liquid onto continuous paper, and a tractor unit 4 that is driven by a DC motor Mt and conveys continuous paper toward the printhead 2 in a secondary scanning direction perpendicular to the primary scanning direction. The printer 1 and printing method also have a load information acquisition unit 23 that, when continuous paper is loaded in the tractor unit 4, drives the tractor units 4 at least two different constant conveyance speeds V1, V2, and acquires load information I1, I2 for the DC motor Mt at the at least two different conveyance speeds.

17 Claims, 8 Drawing Sheets

F1: PAPER SUPPLY OPERATION
F2: MEASUREMENT 1
F3: MEASUREMENT 2
F4: INDEXING ASSIST OPERATION
F5: INDEXING OPERATION

F1: PAPER SUPPLY OPERATION
F2: MEASUREMENT 1
F3: MEASUREMENT 2
F4: INDEXING ASSIST OPERATION
F5: INDEXING OPERATION

F11: PAPER SUPPLY OPERATION
F21: MEASUREMENT 1
F31: MEASUREMENT 2

PRINTER AND PRINTING METHOD

This application claims priority to Japanese Patent Application No. 2010-224107, filed Oct. 1, 2010, the entirety of which is incorporated herein by reference.

BACKGROUND

1. Technical Field

The present invention relates to a printer and a printing method, and relates more particularly to a printer that has a tractor unit and a printing method that uses the printer.

2. Related Art

Japan Patent No. 3791423, for example, teaches a dot impact printer equipped with a tractor unit that reduces the occurrence of paper jams and similar problems and reliably conveys continuous paper to the printhead. This type of dot impact printer is commonly used for printing reports using fanfold paper, which is a type of continuous paper that is folded together into a stack at perforations between pages.

Because fanfold paper usually hangs down from the printer and is fed sequentially from below up into the printer, a paper feed mechanism with greater gripping power than in a printer that prints on cut-sheet paper is used in a dot impact printer. The dot impact printer taught in Japan Patent No. 3791423 uses a tractor unit with tractor pins that engage sprocket holes formed along both sides of the paper width in the paper feed direction as a paper feed mechanism with strong gripping power. A paper feed mechanism using this tractor unit is driven by a stepper motor because of the ease of control, ease of stopping the motor, and the ease of holding the paper where it is stopped.

Demand for high image quality and quiet operation in printers that are used for printing on fanfold paper has also increased. However, because the paper is conveyed by a stepper motor in the dot impact printer taught in Japan Patent No. 3791423, the stepping angle of the stepper motor limits print quality, and sufficiently high image quality cannot be achieved. The stepper motor alone is also noisy, and possibilities for further reducing operating noise are limited.

It is conceivable to use an inkjet head as the printhead in order to achieve high image quality, use a tractor unit in the paper feed mechanism to assure sufficient gripping power, and drive the tractor unit with a DC motor that can operate continuously and quietly in order to achieve low noise operation and high print quality when printing on fanfold paper or other type of continuous paper.

However, when conveying continuous paper by means of a tractor unit driven by a DC motor, heat produced by the DC motor continuously feeding the continuous paper causes the temperature to rise, and can result in the DC motor coil burning out. Some means of controlling heat output is therefore required, such as setting a delay time to create a pause in the DC motor drive time, or setting an upper limit to the drive (paper feed) speed. Controlling the heat output of the DC motor is particularly important because the tractor unit requires a relatively large amount of power to pull up the continuous paper hanging down from the printer.

When fanfold paper is loaded in the tractor units, the fanfold paper is set in the tractor units so that the tractor pins of the left and right side tractor units are inserted to the sprocket holes disposed on both sides of the paper width, and the gap between the left and right tractor units is adjusted to substantially the same as the paper width. As a result, the tension applied across the width of the paper may vary if the gap between the left and right tractor units is adjusted every time fanfold paper is set in the tractor units, such as when reloading the continuous paper supply when the paper supply runs out. The load on the DC motor also varies because the force required for the tractor units to pull the paper up is affected by variation in tension across the paper width. More specifically, the load on the DC motor changes every time paper is loaded into the tractor units.

As a result, if heat output is controlled by overestimating the variable load of the DC motor in order to reliably avoid heat damage to the DC motor that drives the tractor units, the delay time described above becomes longer than necessary or the maximum drive speed must be set lower than needed. Because the number of pages printed per unit time therefore cannot be increased according to the actual printer conditions, it is necessary to acquire more accurate DC motor load information in order to increase the printing speed.

SUMMARY

A printer with a tractor unit driven by a DC motor and a control method for this printer can acquire accurate load information when the paper is reloaded.

A first aspect of the invention is a printer including: a printhead that has a discharge nozzle for discharging liquid onto continuous paper, and can move in a primary scanning direction; a tractor unit that is driven by a DC motor and conveys the continuous paper toward the printhead in a secondary scanning direction perpendicular to the primary scanning direction; and a load information acquisition unit that, when continuous paper is set in the tractor unit, drives the tractor unit at least two different constant conveyance speeds and acquires DC motor load information.

A printer according to this aspect of the invention enables providing a high image quality, quiet printer by combining discharge nozzles with a tractor unit driven by a DC motor. In addition, because the DC motor load can be detected when the continuous paper is set in the tractor unit, the load information acquisition unit can get accurate DC motor load information reflecting how the continuous paper is loaded in the tractor unit. Heat output can therefore be controlled by a heat output control unit that controls driving of the DC motor, in cooperation with a print control unit, so as to control heat output of the motor using the acquired load information. The heat output control unit may control heat output by setting a waiting time or conveyance speed according to the load information, the number of pages printed per unit time by the printer can be increased, and efficient printing is enabled.

In another aspect of the invention, the tractor unit preferably conveys the continuous paper at least two different constant conveyance speeds when conveying the continuous paper so that the leading end of the continuous paper is set to the printing position of the printhead; and the load information acquisition unit acquires the load information related to the at least two different constant conveyance speeds.

A printer according to this aspect of the invention can acquire the above load information when the DC motor load may have changed, such as when continuous paper is reloaded in the tractor unit because the paper ran out and the continuous paper is conveyed to position the leading end of the continuous paper to the printing position of the printhead. Heat output can therefore be controlled based on accurate load information reflecting change in the load characteristic.

In a printer according to another aspect of the invention, the load information acquisition unit acquires load information related to a first conveyance speed while driving the tractor unit and conveying the leading end of the continuous paper at a first conveyance speed to a position not beyond the printing position of the printhead (at or in advance of the printing position along the direction in which the continuous paper is conveyed), acquires load information related to a second conveyance speed that is faster than the first conveyance speed while conveying and positioning the leading end of the continuous paper at the second conveyance speed to the paper discharge side of the printhead printing position, and returns the leading end of the continuous paper to the printing position of the printhead, and starts printing by means of the discharge nozzles.

A printer according to this aspect of the invention can acquire load information related to a first conveyance speed and a second conveyance speed even in a small printer without sufficient space between the printhead and tractor unit by positioning the leading end of the continuous paper to the discharge side of the printhead printing position, and then returning the leading end to the printhead printing position.

Further preferably in a printer according to another aspect of the invention, the load information acquisition unit acquires load information related to a first conveyance speed while conveying the leading end of the continuous paper at the first conveyance speed to a position not beyond the printing position of the printhead (at or in advance of the printing position), acquires load information related to a second conveyance speed that is faster than the first conveyance speed while conveying the leading end of the continuous paper at the second conveyance speed, and positions the leading end of the continuous paper to the printhead printing position, and starts printing by means of the discharge nozzles.

A printer according to this aspect of the invention can get load information related to the first conveyance speed and second conveyance speed during the indexing operation that positions the leading end of the continuous paper to the printing position of the printhead. The wait time between loading continuous paper in the tractor unit and starting printing can therefore be shortened.

Another aspect of the invention is a printing method that prints by discharging liquid onto continuous paper while moving the discharge nozzles in the primary scanning direction, driving a tractor unit by means of a DC motor, and conveying the continuous paper in a secondary scanning direction, including a step of: driving the tractor unit at least two different constant conveyance speeds and acquiring DC motor load information when continuous paper is set in the tractor unit.

The printing method for a printer according to this aspect of the invention acquires DC motor load information when continuous paper is loaded in the tractor unit, and acquires accurate DC motor load information reflecting how the continuous paper is loaded in the tractor unit. Heat output can therefore be controlled by setting a waiting time or conveyance speed limit according to the load information so as to achieve higher native printing speeds.

In a printer control method according to another aspect of the invention, the tractor unit conveys the continuous paper at least two different constant conveyance speeds when conveying the continuous paper so that the leading end of the continuous paper is set to the printing position of the printhead; and acquires load information related to the at least two different constant conveyance speeds.

The printing method for a printer according to this aspect of the invention can acquire the above load information when the DC motor load may have changed, such as when continuous paper is reloaded in the tractor unit because the paper ran out and the continuous paper is conveyed to position the leading end of the continuous paper to the printing position of the printhead. Heat output can therefore be controlled based on accurate load information reflecting change in the load characteristic.

The printing method of a printer according to another aspect of the invention also has steps of: acquiring load information related to a first conveyance speed while conveying the leading end of the continuous paper at a first conveyance speed to a position not beyond the printing position of the printhead (at or in advance of the printing position); acquiring load information related to a second conveyance speed that is faster than the first conveyance speed while conveying and positioning the leading end of the continuous paper at the second conveyance speed to the paper discharge side of the printhead printing position; and returning the leading end of the continuous paper to the printing position of the printhead, and starting printing by means of the discharge nozzles.

A printing method for a printer according to this aspect of the invention can acquire load information related to a first conveyance speed and a second conveyance speed even in a small printer without sufficient space between the printhead and tractor unit by positioning the leading end of the continuous paper to the discharge side of the printhead printing position, and then returning the leading end to the printhead printing position.

A printing method for a printer according to another aspect of the invention preferably also has steps of acquiring load information related to a first conveyance speed while conveying the leading end of the continuous paper at a first conveyance speed to a position not beyond the printing position of the printhead (at or in advance of the printing position); acquiring load information related to a second conveyance speed that is faster than the first conveyance speed while conveying the leading end of the continuous paper at the second conveyance speed, and positions the leading end of the continuous paper to the printhead printing position; and starting printing by means of the discharge nozzles.

A printer according to this aspect of the invention can get load information related to the first conveyance speed and second conveyance speed during the indexing operation that positions the leading end of the continuous paper to the printing position of the printhead. The wait time between loading continuous paper in the tractor unit and starting printing can therefore be shortened.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

General Configuration

Figure 1:
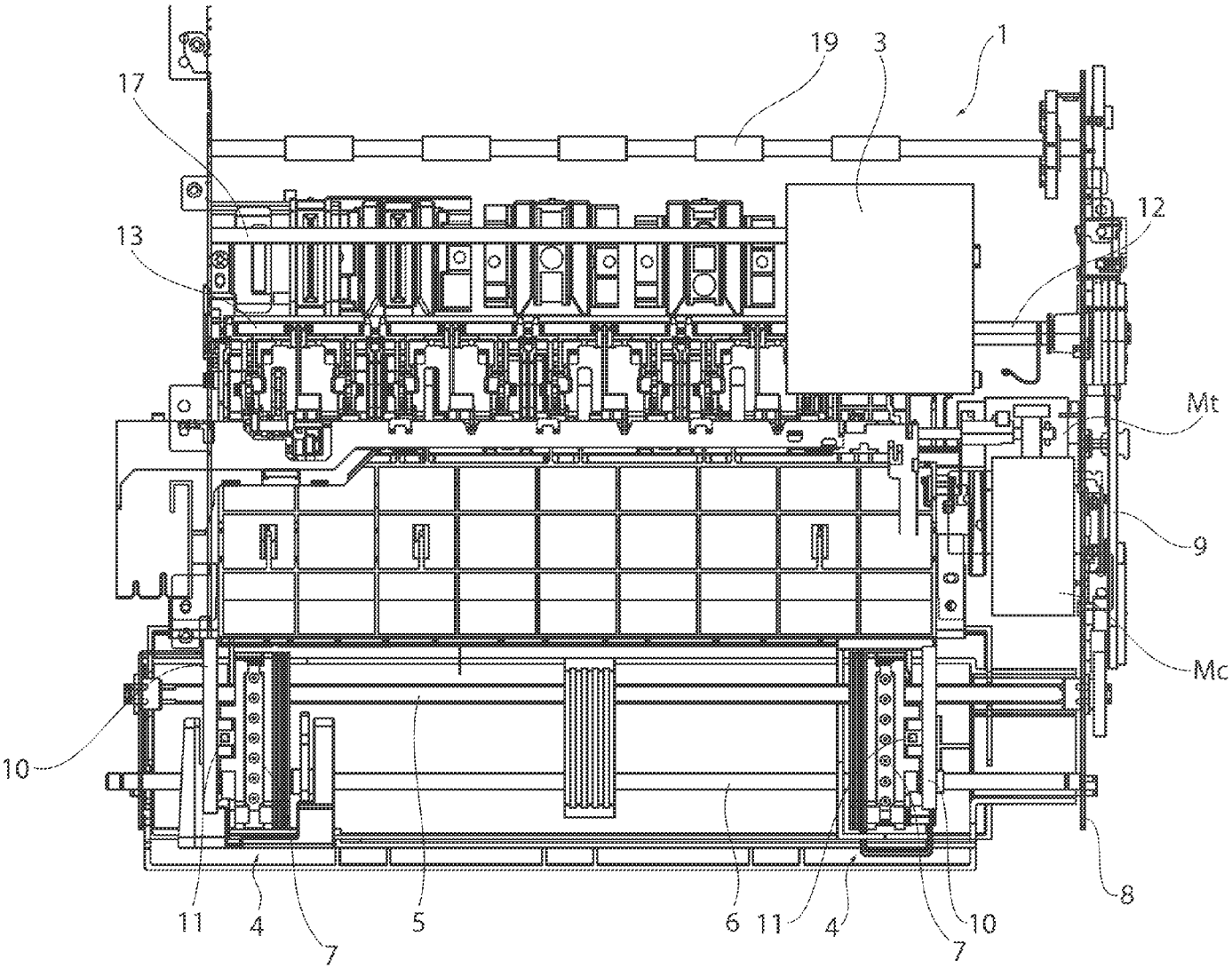
FIG. 1 is a top view of a printer according to a preferred embodiment of the invention.

As shown in FIG. 1, a printer 1 according to this embodiment of the invention has a frame; a carriage 3 that is disposed movably in the primary scanning direction of the printer 1 and carries a printhead 2 (see FIG. 6) that discharges ink (liquid) from discharge nozzles to print on fanfold paper or other continuous paper; a pair of left and right tractor units 4 that convey the continuous paper toward the printhead 2 in a secondary scanning direction perpendicular to the primary scanning direction; and a case (not shown) that encloses the carriage 3 and tractor units 4.

Note that fanfold paper is a type of continuous paper that is folded together into a stack at perforations extending across the paper width with a specific gap therebetween in the conveyance direction.

Tractor units known from the literature can be used for the tractor units 4. For example, as shown enlarged in FIG. 2, the tractor units 4 in this embodiment of the invention have a rotating guide shaft 5 that is disposed rotatably in the primary scanning direction; a fixed guide shaft 6 that does not rotate and is disposed parallel to the rotating guide shaft 5 on the upstream side in the secondary scanning direction; a drive gear that is fixed to the rotating guide shaft 5 and rotates in unison with the rotating guide shaft 5; a follower gear that is attached freely rotatably to the fixed guide shaft 6; and a tractor belt 7 that is mounted on the drive gear and follower gear and has tractor pins on the outside surface thereof.

A tractor gear 8 is fixed so that it cannot rotate on one end of the rotating guide shaft 5. Power from the DC motor used as the tractor motor Mt fastened to the frame is transferred to the tractor gear 8 through the conveyance-side belt and pulley mechanism 9 including the timing belt and gear train, thus driving the tractor belt 7 as a result of the rotating guide shaft 5 turning and the drive gear transferring power.

The tractor unit 4 also has a clamp 10 that can switch between a clamping position opposite the tractor pins of the tractor belt 7 preventing the continuous paper from disengaging the tractor pins, and an open position (where the clamp 10 is perpendicular to the conveyance surface as shown in the figure) that allows removing and installing the continuous paper. The user sets the continuous paper in the tractor unit 4 by opening the clamp 10, setting the sprocket holes disposed along both edges of the continuous paper over the tractor pins, and then closing the clamp 10 to the clamping position.

The left and right tractor units 4 can move axially along the rotating guide shaft 5 and fixed guide shaft 6, and the gap between the left and right tractor units 4 can be adjusted according to the width of the continuous paper. The user can therefore adjust the gap between the left and right tractor units 4, or adjust the tractor units 4 to continuous paper of different widths, in order to reduce paper jams after paper is loaded.

The tractor unit 4 also has a tractor-side paper sensor 11 near the tractor belt 7, that can detect when continuous paper is loaded in the tractor units 4. The tractor-side paper sensor 11 in this embodiment of the invention is a push-button sensor, the end of which is depressed by the continuous paper when loaded in the tractor unit 4, thereby detecting when the continuous paper is loaded into the tractor unit 4.

Figure 2:
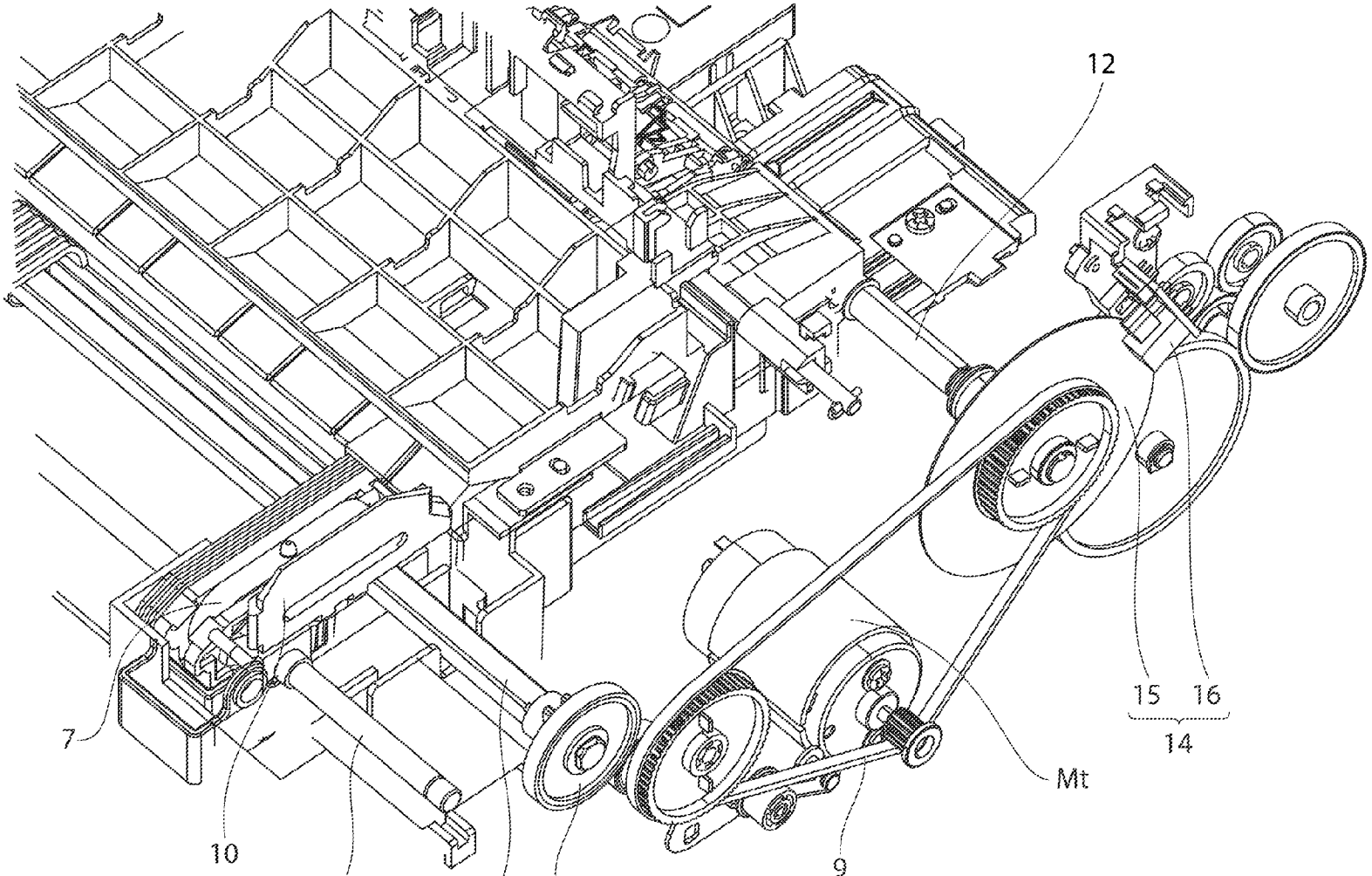
FIG. 2 is an enlarged oblique view of part of the printer shown in FIG. 1.

A paper feed shaft 12 that is driven by the tractor motor Mt through the intervening conveyance-side belt and pulley mechanism 9 is disposed extending in the primary scanning direction downstream from the tractor unit 4 in the conveyance direction, and a paper feed roller 13 (see FIG. 1), that rotates in unison with the paper feed shaft 12, is affixed to the paper feed shaft 12. A rotation sensor 14 is also disposed to one end of the paper feed shaft 12 as shown in FIG. 2.

The rotation sensor 14 includes a disc-shaped encoder 15, the outside edge of which is magnetized with alternating north and south poles, that is attached non-rotatably to the paper feed shaft 12, and an encoder sensor 16 disposed opposite the encoder 15. The speed of the paper feed roller 13 and the continuous paper conveyance speed V can be detected from this rotation sensor 14. The rotation sensor 14 is not limited to this configuration, and other means of detecting rotation known to one of skill in the art could be used, such as using an encoder with holes formed intermittently therein in the radial direction.

Figure 6:
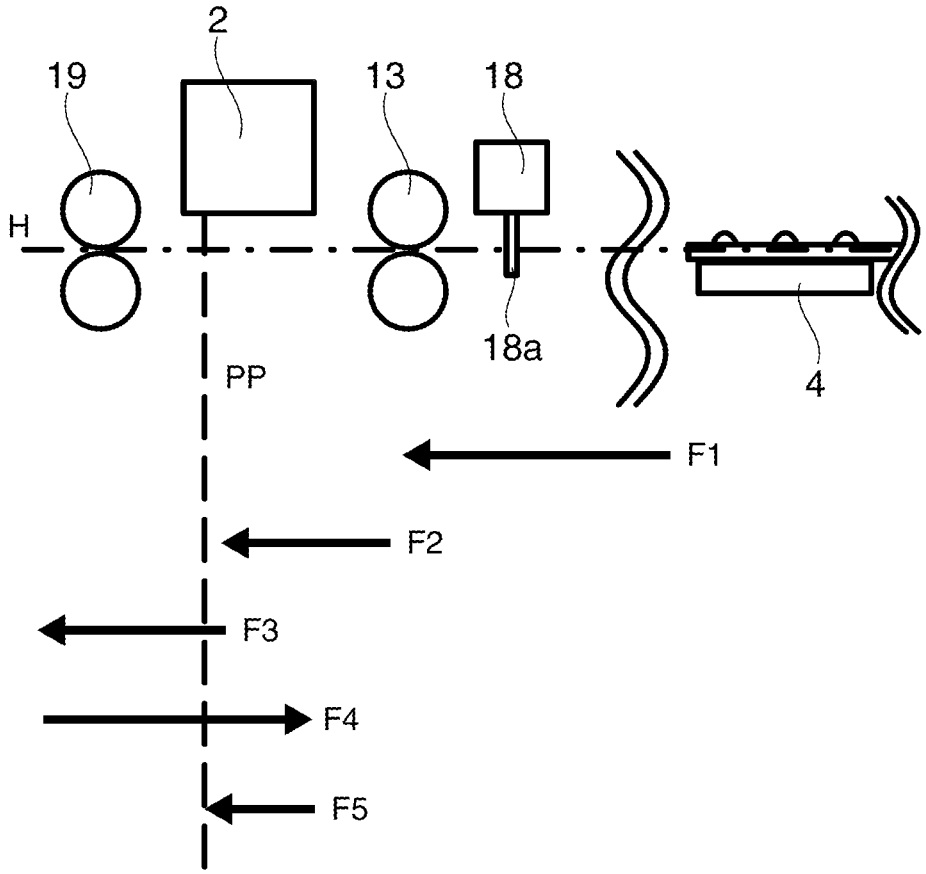
FIG. 6 describes the position of the leading end of the continuous paper in each step of the measurement process of the invention.

A paper feed sensor 18 is also disposed upstream in the conveyance direction from the paper feed roller 13 (see FIG. 6). The paper feed sensor 18 has a lever 18*a* that protrudes into the conveyance path of the conveyed continuous paper that can detect when the lever 18*a* contacts and is tripped by the continuous paper. Therefore, when the leading end of the continuous paper contacts the lever 18*a*, the lever 18*a* trips, which indicates that the continuous paper was fed to just before the paper feed roller 13.

The carriage 3 (see FIG. 1) is disposed movably in the primary scanning direction downstream in the conveyance direction from the paper feed roller 13. A printhead 2 is disposed below the carriage 3 (on the side facing the continuous paper), and the carriage 3 can move along a carriage guide shaft 17 that is disposed to the frame and extends in the primary scanning direction Ink is supplied to the discharge nozzles of the printhead 2 through an ink tube from an ink cartridge (not shown) affixed to the frame or carriage 3. Power from a carriage motor Mc affixed to the frame is transferred through a carriage-side belt and pulley mechanism (not shown) to the carriage 3, enabling the carriage 3 to move along the carriage guide shaft 17 (see FIG. 1).

Discharge rollers 19 that are driven by the tractor motor Mt through the conveyance-side belt and pulley mechanism 9 and discharge the printed continuous paper are disposed downstream in the conveyance direction from the printhead 2 (see FIGS. 1 and 6).

The printing operation of the printer 1 described above is described next.

Figure 3:
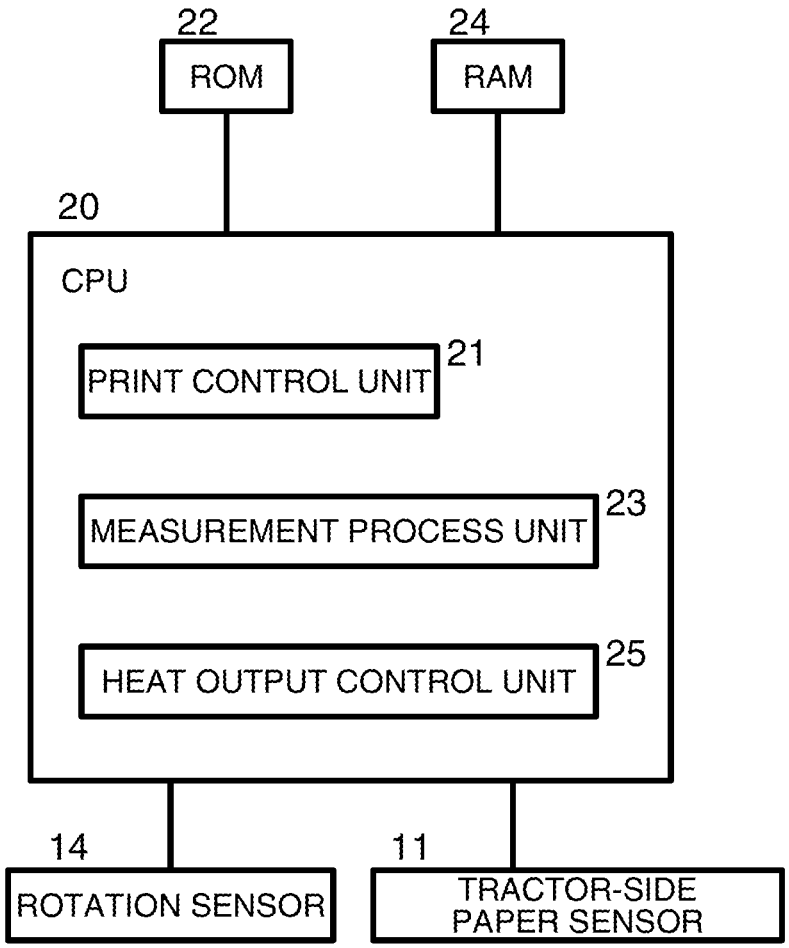
FIG. 3 is a block diagram of the control system of the printer shown in FIG. 1.

When the printer 1 power turns on, the CPU 20 of the printer 1 shown in the block diagram in FIG. 3 reads a program stored in ROM 22, and the print control unit 21, measurement process unit 23 (load information acquisition unit), and heat output control unit 25 embodied in the CPU 20 respectively execute a printing control process, measurement process, and heat output control process.

The print control unit 21 controls driving the tractor motor Mt, driving the carriage motor Mc, and the discharge operation of the discharge nozzles of the printhead 2 according to the print data, and prints on the continuous paper. Note that driving the tractor motor Mt is controlled by the heat output control of the heat output control unit 25 described below.

The measurement process unit 23 executes the measurement process when continuous paper has been loaded to the tractor units and there is the possibility that the tractor motor Mt load has changed, such as when the power turns on or when continuous paper is set in the tractor units 4. The measurement process drives the tractor motor Mt at least two different constant conveyance speeds V, calculates the load characteristic L by acquiring the tractor motor Mt load for each of the at least the two different paper conveyance speeds V, and sets the limit used for heat control by the heat output control unit 25 based on the load characteristic L.

When paper is conveyed by the tractor motor Mt to print, the heat output control unit 25, in cooperation with the print control unit 21, executes a process to limit the heat output of the tractor motor Mt by, for example, setting the wait time Twait of the tractor motor Mt drive operation or varying the conveyance speed V. By using the limit value set by the measurement process unit 23, the heat output control unit 25 can control heat output to accurately reflect the actual load characteristic, which can change each time continuous paper is set in the tractor units 4.

Measurement Process

Figure 4:
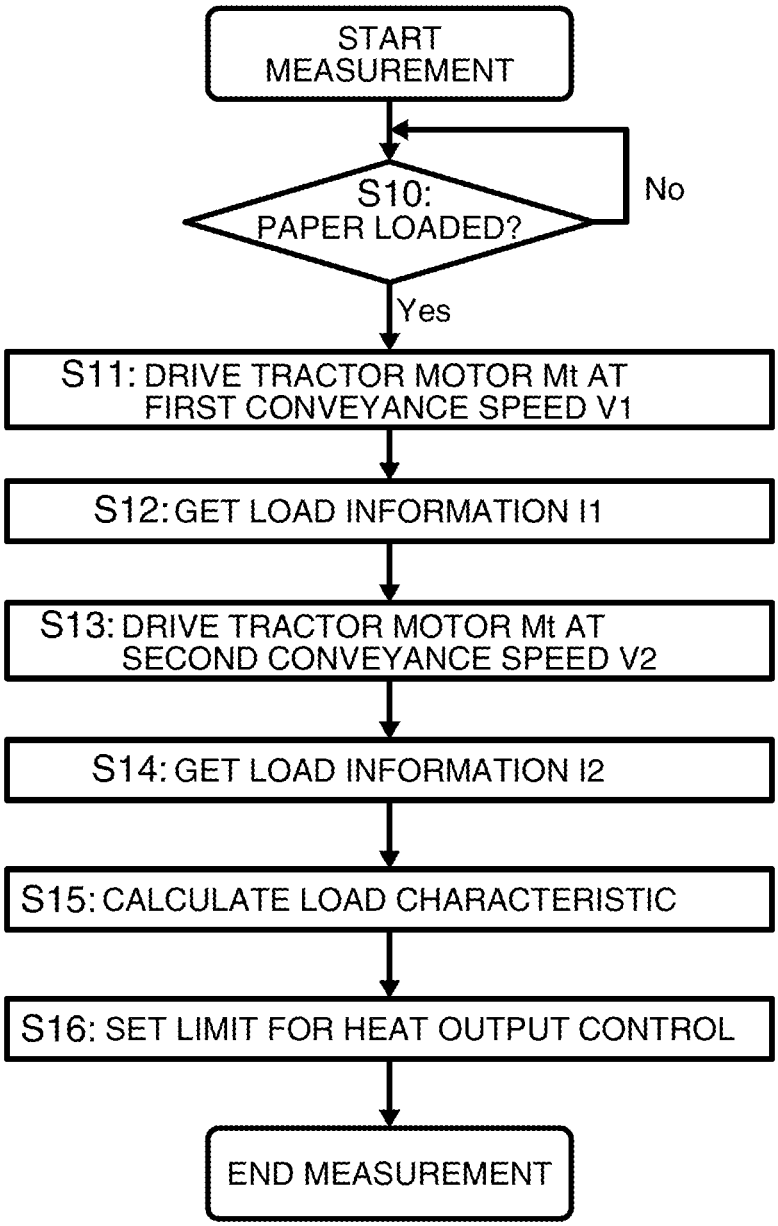
FIG. 4 is a flow chart of the measurement process of the invention.

The measurement process is described in further detail below. When the measurement process unit 23 of the CPU 20 is told to start the measurement process, the measurement process unit 23 executes the process shown in FIG. 4.

The measurement process unit 23 first checks if continuous paper has been loaded in the tractor unit 4 based on the output of the tractor-side paper sensor 11 (step S10). If continuous paper has not been set in the tractor unit 4 (step S10 returns No), an indicator that prompts the user to load continuous paper is driven to flash, and operation waits for continuous paper to be loaded.

If step S10 determines that continuous paper was loaded in the tractor unit 4, the measurement process unit 23 drives the media transportation mechanism while applying PID control so that the continuous paper is conveyed at a constant first conveyance speed V1. Note that the conveyance speed V of the continuous paper is input to the measurement process unit 23 as the output of the rotation sensor 14 (see FIG. 3).

When the conveyance speed V of the continuous paper becomes stable at the first conveyance speed V1, the measurement process unit 23 records current I1 input to the tractor motor Mt (step S12). When the current I has been recorded for a specific time, such as the time required for the tractor motor Mt to turn 1½ revolutions, with the conveyance speed V of the continuous paper at the first conveyance speed V1, the time average I1 of the current I is calculated. The current I1 represents the load of the tractor motor Mt required to convey the continuous paper at first conveyance speed V1.

The measurement process unit 23 then drives the tractor motor Mt so that the continuous paper is conveyed constant at the constant second conveyance speed V2, the second conveyance speed V2 being different from the first conveyance speed V1 (step S13). If the conveyance speed V of the continuous paper is confirmed to be constant at the second conveyance speed V2, the measurement process unit 23 records the current I input to the tractor motor Mt (step S14). If current I is recorded for a predetermined time after the conveyance speed of the continuous paper reaches the second conveyance speed V2, the time average I2 of the current I is calculated. This current I2 denotes the tractor motor Mt load required to convey continuous paper at the second conveyance speed V2.

Figure 5:
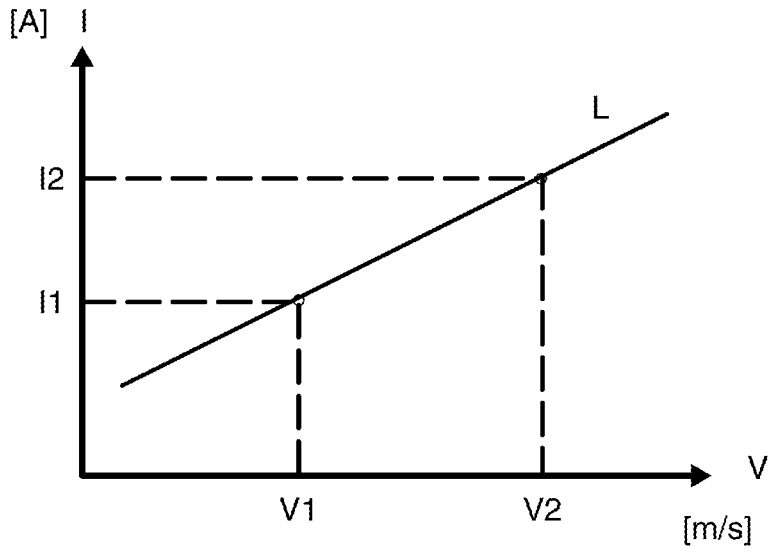
FIG. 5 is a graph describing the load characteristic of the tractor motor of the invention.

In step S15, the measurement process unit 23 calculates the linear correlation between the conveyance speed V and the load information I from the first and second conveyance speeds V1, V2 and currents I1, I2, and stores this linear correlation as the load characteristic L in RAM 24. The tractor motor Mt load (current I) required to convey the continuous paper at a specific conveyance speed V can be estimated using the load characteristic L. An example of this linear relationship is illustrated in FIG. 5.

When the load characteristic L is calculated as in step S15, the measurement process unit 23 sets and stores the limit for heat output control by the heat output control unit 25 using the load characteristic L in RAM 24 (step S16). Because the current I of the tractor motor Mt at a specific conveyance speed V can be estimated from the load characteristic L, the power, or heat output, produced by the tractor motor Mt can also be estimated. This value can be used to set the heat output control limit. The heat output control limit is the maximum Pduty for driving the tractor motor Mt in the example described below. If the heat output of the tractor motor Mt is limited by varying the conveyance speed V, the maximum conveyance speed V can be used as the upper limit. This limit can be changed in many ways appropriate to the method of controlling heat output.

Although in the embodiment described above the measurement process unit 23 measures the current I1, I2 flowing to the tractor motor Mt at the first and second conveyance speeds V1, V2, and acquires the load characteristic L based on a linear relationship between the conveyance speed V and current I, the invention is not so limited. For example, the current I required to convey the continuous paper at three different conveyance speeds V could be acquired, the linear accuracy of the load characteristic L could be improved, or the load characteristic L could be acquired as a curve.

The measurement process noted above can be executed while conveying the continuous paper as described below. FIG. 6 schematically describes the relative positions of the conveyance path H rendered by the paper feed roller 13, printhead 2, and discharge rollers 19, and the leading end of the continuous paper in steps S11 to S14 of the measurement process.

The leading end of the continuous paper is conveyed from the tractor unit 4 to the paper feed roller 13 as indicated by arrow F1 before the measurement process starts. Once the leading end of the continuous paper is nipped by the paper feed roller 13 in the paper feed operation F1, the measurement process unit 23 acquires the load information I1 while conveying the continuous paper at the first conveyance speed V1 so that the leading end of the continuous paper is positioned near the printing position PP of the printhead 2 (steps S11, S12).

Next, the measurement process unit 23 feeds the continuous paper at the second conveyance speed V2, which is faster than first conveyance speed V1, while acquiring the load information I2 at the second conveyance speed V2 until the leading end of the continuous paper passes the printing position PP and almost reaches the discharge roller (steps S13, S14). Note that the time required for the conveyance speed V to stabilize at first conveyance speed V1 can be shortened by driving at second conveyance speed V2 after driving at the first conveyance speed V1, the second conveyance speed V2 being faster than first conveyance speed V1. The leading end of the print area is an area located a specific margin behind the leading edge of the continuous paper.

Once load information I2 is obtained, the measurement process unit 23 performs an indexing assist operation that returns the leading end of the continuous paper to the paper feed side of the printing position PP as shown by arrow F4, performs an indexing operation that positions the leading end of the print area on the continuous paper to the printing position PP as shown by arrow F5, and prepares for the next printing process. Note that this indexing operation can position the leading end of the print area of the continuous paper to the printing position of the printhead 2 by detecting the leading end of the continuous paper by means of the paper feed sensor 18 and advancing the medium a specific distance.

When the measurement process is executed while conveying the continuous paper as described above, the load information I1 and I2 of the tractor motor Mt at two different first and second conveyance speeds V1 and V2, respectively, can be acquired even in a small printer in which a sufficient gap between the printhead 2 and paper feed roller 13 cannot be assured.

Figure 7:
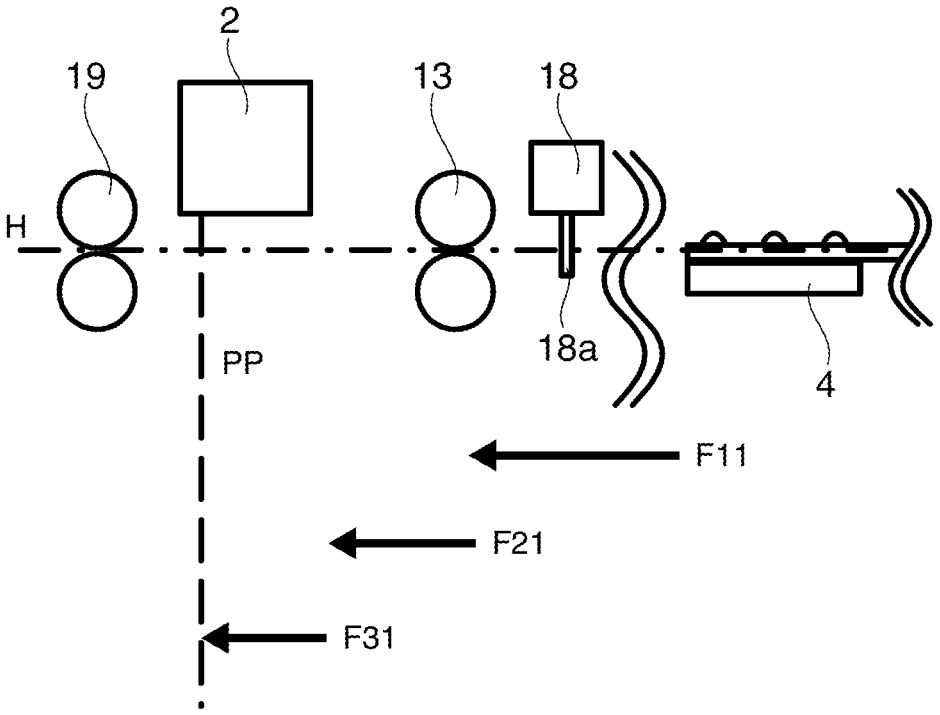
FIG. 7 describes the position of the leading end of the continuous paper in each step of the measurement process in another embodiment of the invention.

In another embodiment of the invention, the measurement process is executed while conveying the continuous paper as shown in FIG. 7.

In the embodiment shown in FIG. 7, after a paper feed operation that conveys the leading end of the continuous paper from the tractor unit 4 to the paper feed roller 13 as shown by arrow F11, the measurement process unit 23 conveys the leading end of the continuous paper at the first conveyance speed V1 from the paper feed roller 13 to the printing position PP as shown by arrow F21, and acquires the tractor motor Mt at the first conveyance speed (steps S11, S12). Next, the measurement process unit 23 conveys the continuous paper at a second conveyance speed V2 that is faster than the first conveyance speed V1 until the leading end of the printing position on the continuous paper reaches the printing position PP as shown by arrow F31, and acquires the tractor motor Mt load information l2 at the second conveyance speed V2 (steps S13, S14).

If the measurement process is executed while conveying the continuous paper as described above, the measurement process can be incorporated in the indexing operation that positions the leading end of the print area of the continuous paper to the printing position PP, thereby shortening the delay until printing starts after setting the continuous paper in the tractor units 4.

The measurement process described above can more reliably determine the load information because the tractor motor Mt (DC motor) load when the continuous paper is set in the tractor units 4 can be acquired when an operation causing the tractor unit 4 load to vary is performed, such as when the power turns on or when the continuous paper is installed to the tractor unit 4.

Heat Output Control Process

Figure 8:
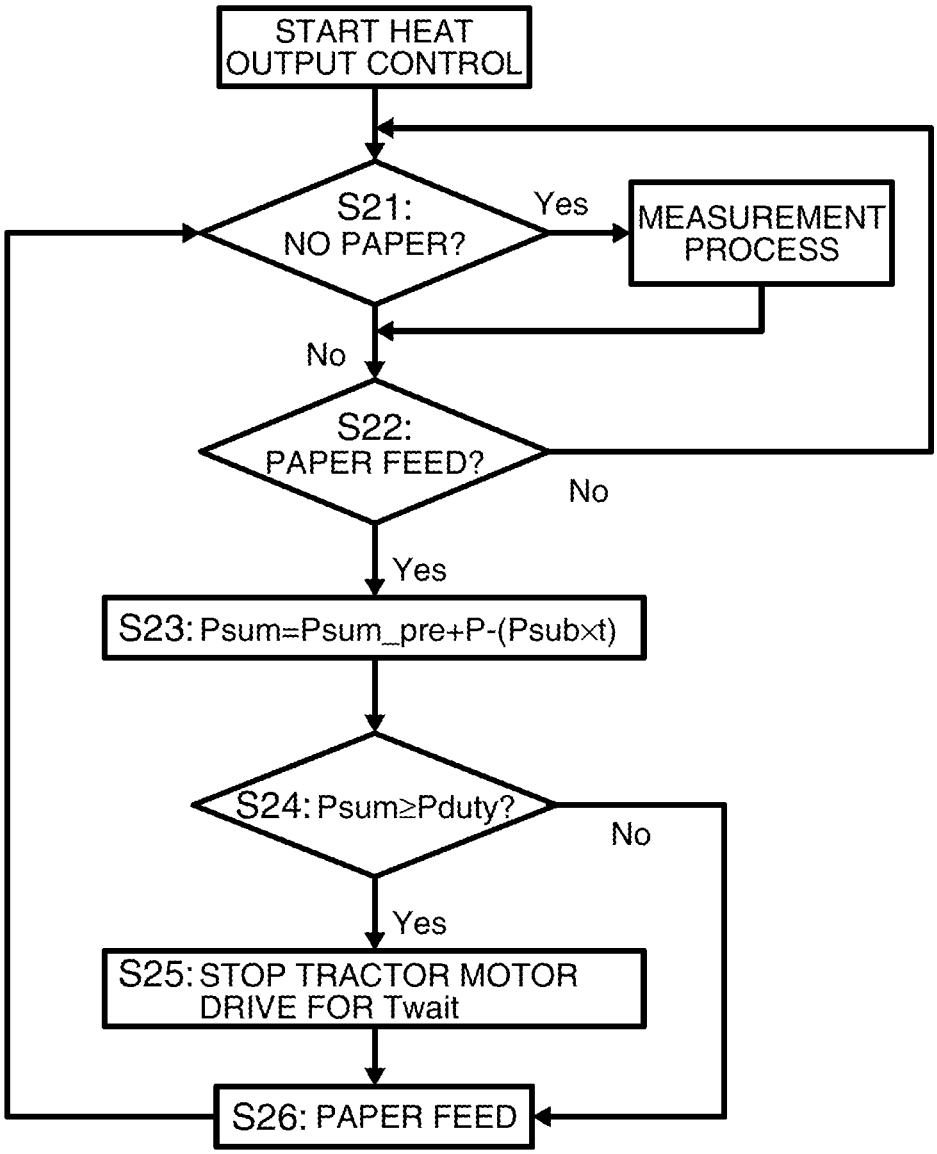
FIG. 8 is a flow chart showing an example of the heat output control process of the invention using a load characteristic.

The heat output control process using the load characteristic L obtained as described above is described next with reference to FIG. 8. This heat output control process, which limits the heat output of the tractor motor Mt, is performed by the heat output control unit 25 simultaneously to printing control by the print control unit 21.

In order to prevent heat damage to the tractor motor Mt, the heat output control process described below focuses on overheating of the tractor motor Mt when a heat-producing paper feed operation repeats continuously. When the total drive amount Psum reaches the maximum Pduty, the heat output control unit 25 imposes a wait time Twait on driving the tractor motor Mt.

Note that this maximum Pduty denotes how much the motor must be driven for the temperature of the tractor motor Mt to reach a temperature where damage is possible. This maximum Pduty is a value set by the measurement process unit 23 according to the load characteristic L described above. When the conveyance speed V is high and the load is high, the maximum Pduty is set low, and when the conveyance speed V is low and the load is small, the maximum Pduty is set high. Note, further, that the amount the tractor motor Mt is driven as the total drive amount Psum can be acquired from the rotation sensor 14.

As described above, the heat output control unit 25 determines if the paper supply has run out (step S21) from the output of the tractor-side paper sensor 11 (see FIG. 1). If the tractor unit 4 has not run out of paper, the heat output control unit 25 determines if the tractor motor Mt is being used to convey the paper (step S22).

If the heat output control unit 25 determines that the media is not being conveyed, the process returns to step S21. If the tractor motor Mt is conveying paper (step S22 returns Yes), the heat output control unit 25 adds the current drive amount P to the previous drive amount Psum_pre to get total drive amount Psum, and reduces the sum by Psub*t (Psum=Psum_Pre+P−Psub*t) (step S23).

The quantity Psub*t used here is a tractor motor Mt cooling correction value corresponding to the elapsed time t between the end of driving the tractor motor Mt and the current time. Because the total drive amount can be thought of as the cumulative heat output, the cooling component can be subtracted from the total drive amount according to the elapsed time. Because the total drive amount can also be thought of as the total heat output, the cooling component is subtracted from the total drive amount according to the elapsed time. Note that if the elapsed time t is greater than a sufficiently long time tmax (t>tmax), the tractor motor Mt is determined to have cooled sufficiently, and the cumulative drive amount Psum is reset to 0 (Psum=0).

The heat output control unit 25 then determines if the cumulative drive amount Psum obtained in step S23 is greater than the maximum Pduty set by the measurement process unit 23. If the cumulative drive amount Psum is less than maximum Pduty (Psum<Pduty), the heat output control unit 25 goes to step S26, the tractor motor Mt is driven to feed the paper, and printing continues.

However, if the heat output control unit 25 determines in step S24 that the cumulative drive amount Psum is greater than or equal to maximum Pduty (Psum≥Pduty), the heat output control unit 25 stops driving the tractor motor Mt for the wait time Twait set by the measurement process unit 23 based on the load characteristic L and the conveyance speed V (step S25). When the wait time Twait passes, the heat output control unit 25 drives the tractor motor Mt, conveys the paper, and prints (step S26). In other words, when heat damage to the tractor motor Mt is possible, driving the tractor motor Mt is prohibited for wait time Twait to prevent the tractor motor Mt from heating more.

If the tractor-side paper sensor 11 detects that there is no paper in step S21, the measurement process is executed after paper is supplied, and steps S22 to S26 whereby Pduty, Psub, and Twait are reset based on the updated load characteristic L are executed. The measurement process is also performed each time the power turns on, Pduty, Psub, and Twait are reset based on the load characteristic L obtained in the measurement process, and the printing process is executed.

The heat output control process described above executes each time the tractor motor Mt is driven. As a result, when there is a danger of the tractor motor Mt overheating and becoming damaged while printing print data over plural lines, the process prohibits driving the tractor motor Mt so as to reliably prevent heat damage to the tractor motor.

The heat output control process according to this embodiment of the invention can set the maximum Pduty based on accurate load information that also considers variation in the load on the tractor unit 4, for example when continuous paper is set in the tractor units 4 and the tension on the continuous paper change, so as to more reliably prevent heat damage to the tractor motor Mt. In addition, because this heat output control sets the maximum Pduty to a low value when the conveyance speed V is high, and sets the maximum Pduty to a high value when the conveyance speed V is low, the load information will not be overestimated, and the number of pages printed per unit time can be increased according to the printer 1 condition.

The heat output control process described above limits the heat output of the tractor motor Mt by making the tractor motor Mt wait for wait time Twait, but the heat output of the tractor motor Mt can be limited by reducing the conveyance speed V when the cumulative drive amount Psum equals or exceeds the maximum Pduty. many ways. Such variations are not to be regarded as a departure from the spirit and scope of the invention, and all such modifications as would be obvious to one skilled in the art are intended to be included within the scope of the following claims.

What is claimed is:

1. A printer comprising:

a printhead that has a discharge nozzle for discharging liquid onto continuous paper and that is movable in a primary scanning direction;

a tractor unit that is driven by a DC motor and conveys continuous paper toward the printhead in a secondary scanning direction substantially perpendicular to the primary scanning direction, wherein the tractor unit conveys the continuous paper at at least two different constant conveyance speeds when conveying the continuous paper so that a leading end of the continuous paper is set to a printing position of the printhead; and a load information measurement unit coupled with the tractor unit such that, when continuous paper is loaded in the tractor unit, the load information measurement unit drives the tractor unit at at least two different constant conveyance speeds in a conveyance direction and measures DC motor load information during conveyance, wherein the load information measurement unit measures the load information related to each of the at least two different constant conveyance speeds.

2. The printer of claim 1, wherein the at least two different constant conveyance speeds comprise a first and a second conveyance speed, the second speed being faster than the first, and the load information measurement unit is operatively coupled to the tractor unit so as to:

measure load information related to the first conveyance speed while driving the tractor unit and conveying the leading end of the continuous paper at the first conveyance speed to a position at or in advance of the printing position of the printhead, measure load information related to the second conveyance speed while conveying and positioning the leading end of the continuous paper at the second conveyance speed to the paper discharge side of the printhead printing position, and return the leading end of the continuous paper to the printing position of the printhead and start printing using the discharge nozzles.

3. The printer of claim 1, wherein the at least two different constant conveyance speeds comprise a first and a second conveyance speed, the second speed being faster than the first, and the load information measurement unit is operatively coupled to the tractor unit so as to:

measure load information related to the first conveyance speed while conveying the leading end of the continuous paper at the first conveyance speed to a position at or in advance of the printing position of the printhead, measure load information related to the second conveyance speed while conveying the leading end of the continuous paper at the second conveyance speed, and position the leading end of the continuous paper to the printhead printing position, and start printing using the discharge nozzles.

4. The printer of claim 1, further comprising:

a print control unit that controls driving of the tractor unit, the driving of the DC motor, and discharge of liquid from the discharge nozzle to the continuous paper; and a heat output control unit that controls driving of the DC motor, in cooperation with the print control unit, so as to control heat output using the acquired load information.

5. The printer of claim 4, wherein the heat output control unit controls heat output by setting a wait time of the tractor unit during a printing process for printing to the continuous paper.

6. The printer of claim 4, wherein the heat output control unit controls heat output by varying a conveyance speed of the tractor motor unit during a printing process for printing to the continuous paper.

7. The printer of claim 4, wherein the load information measurement unit measures load information relating to the at least two different constant conveyance speeds in response to continuous paper being loaded in the tractor unit.

8. The printer of claim 7, wherein the heat output control unit controls heat output during a printing process for printing to the continuous paper using load information acquired by the load information measurement unit.

9. A printing method of printing onto a continuous paper by discharging liquid onto the continuous paper while moving discharge nozzles in a primary scanning direction, the method comprising:

driving a tractor unit with a DC motor so as to convey the continuous paper in a secondary scanning direction at at least two different constant conveyance speeds in a conveyance direction, wherein the tractor unit conveys the continuous paper so that a leading end of the continuous paper is set to a printing position of the printhead; and measuring DC motor load information, when the continuous paper is loaded into the tractor unit, wherein measuring DC motor load information comprises acquiring the load information related to each of the at least two different constant conveyance speeds, wherein driving the tractor unit and measuring load information occurs in response to the continuous paper being loaded into the tractor unit and is performed before printing onto the continuous paper by discharging liquid from the discharge nozzles.

10. The printing method of claim 9, wherein the at least two conveyance speeds comprise a first conveyance speed and a second conveyance speed, the second conveyance speed being faster than the first conveyance speed, and wherein acquiring load information comprises:

measuring load information related to the first conveyance speed while conveying the leading end of the continuous paper at the first conveyance speed to a position at or in advance of the printing position of the printhead, and measuring load information related to the second conveyance speed while conveying and positioning the leading end of the continuous paper at the second conveyance speed to the paper discharge side of the printhead printing position, the method further comprising:

returning the leading end of the continuous paper to the printing position of the printhead after acquiring load information, and starting printing using the discharge nozzles.

11. The printing method of claim 9, wherein the at least two conveyance speeds comprise a first conveyance speed and a second conveyance speed, the second conveyance speed being faster than the first conveyance speed, and wherein measuring load information comprises:

acquiring load information related to the first conveyance speed while conveying the leading end of the continuous paper at the first conveyance speed to a position at or in advance of the printing position of the printhead, and acquiring load information related to the second conveyance speed while conveying the leading end of the continuous paper at the second conveyance speed, the method further comprising:

positioning the leading end of the continuous paper to the printhead printing position after acquiring load information, and starting printing to the continuous paper using the discharge nozzles.

12. The printing method of claim 9, further comprising:

controlling heat output of the DC motor during printing onto the continuous paper using the acquired load information.

13. The printing method of claim 12, wherein controlling heat output of the DC motor comprises adjusting conveyance of the continuous paper during a printing process for printing onto the continuous paper using the discharge nozzles.

14. The printing method of claim 13, wherein adjusting conveyance of the continuous paper comprises changing a conveyance speed of the continuous paper during the printing process between the at least two different conveyance speeds.

15. The printing method of claim 13, wherein adjusting conveyance of the continuous paper comprises setting a wait time of the tractor motor during the printing process.

16. The printing method of claim 13, wherein adjusting conveyance of the continuous paper comprises varying a conveyance speed of the continuous paper during the printing process.

17. A printing method of printing onto continuous paper, the method comprising:

driving a tractor unit with a motor, in response to loading of the continuous paper onto the tractor unit, so as to convey the continuous paper toward one or more liquid discharge nozzles at a first constant conveyance speed in a conveyance direction and a second constant conveyance speed in the conveyance direction, the second conveyance speed being different than the first, wherein the tractor unit conveys the continuous paper so that a leading end of the continuous paper is set to a printing position of the printhead;

measuring load information of the motor at each of the first and second conveyance speeds during conveyance, wherein measuring motor load information comprises acquiring the load information related to each of the at least two different constant conveyance speeds, wherein driving the tractor unit and measuring load information occurs in response to the continuous paper being loaded into the tractor unit and is performed before printing onto the continuous paper by discharging liquid from the discharge nozzles; and printing onto the continuous paper with the one or more liquid discharge nozzles during a printing process in which the tractor unit conveys the continuous paper to the one or more liquid discharge nozzles at a printing conveyance speed determined in part by the measured load information so as to control the load of the motor during the printing process.

* * * * *